US007682124B2

(12) United States Patent
Miyazaki et al.

(10) Patent No.: US 7,682,124 B2
(45) Date of Patent: Mar. 23, 2010

(54) TRACTOR WITH BACKHOE

(75) Inventors: Eiji Miyazaki, Sakai (JP); Shuichi Takeshita, Sakai (JP); Tsuyoshi Aoki, Sakai (JP)

(73) Assignee: Kubota Corporation, Osaka (JP)

( * ) Notice: Subject to any disclaimer, the term of this patent is extended or adjusted under 35 U.S.C. 154(b) by 163 days.

(21) Appl. No.: 11/375,360

(22) Filed: Mar. 14, 2006

(65) Prior Publication Data

US 2006/0254415 A1 Nov. 16, 2006

(30) Foreign Application Priority Data

May 16, 2005 (JP) ..... 2005-143091

(51) Int. Cl.
*E02F 3/36* (2006.01)

(52) U.S. Cl. ..... 414/694; 414/918

(58) Field of Classification Search ..... 414/694, 414/918; 37/443

See application file for complete search history.

(56) References Cited

U.S. PATENT DOCUMENTS 3,047,171 A * 7/1962 Long ..... 414/694
3,752,337 A * 8/1973 Pinkham et al. ..... 414/734
4,142,642 A * 3/1979 Myers ..... 414/719
6,637,136 B2 10/2003 Aoki et al.
6,684,537 B2 2/2004 Ichikawa et al.
6,872,043 B2 * 3/2005 Yukawa et al. ..... 414/694
2005/0210716 A1 9/2005 Miyazaki

FOREIGN PATENT DOCUMENTS

JP 2000-345582 12/2000
JP 2003-20674 1/2003

* cited by examiner

*Primary Examiner*—Donald Underwood
(74) *Attorney, Agent, or Firm*—The Webb Law Firm

(57) ABSTRACT

A tractor with a backhoe is disclosed. The backhoe is mounted to a rear portion of the tractor. The backhoe has a boom, an arm pivotally supported to a leading end of the boom, a bucket pivotally supported to a leading end of the arm, a boom cylinder for operating the boom, an arm cylinder for operating the arm and a bucket cylinder for operating the bucket. The tractor includes a frame attached to a rear portion of the tractor, a swing bracket supported to a rear portion of the frame to be pivotable about a vertical axis, a control valve unit having control valves for controlling the boom cylinder, the arm cylinder and the bucket cylinder and a hose unit for feeding pressure oil from the control valve unit to the boom cylinder, the arm cylinder and the bucket cylinder. The wing bracket includes a first opening open to the front side and a second opening open to the rear side. The control valve unit is disposed, in its plan view, on an extension line of the first opening and the second opening. The hose unit extends substantially linearly from the control valve unit through the first opening to the second opening.

9 Claims, 13 Drawing Sheets

TRACTOR WITH BACKHOE

BACKGROUND OF THE INVENTION

1. Field of the Invention

The present invention relates to a tractor having a backhoe attached to a rear side thereof.

2. Description of the Related Art

According to a conventional tractor with a backhoe of the above-noted type, the tractor includes a frame detachably attached to the rear portion of the tractor. To the rear portion of this frame, a swing bracket is supported to be pivotable about a vertical axis. To a rear lower portion of the swing bracket, a base portion of a boom is pivotally connected to be pivotable about a right/left axis. To the leading end of the boom, an arm is pivotally connected to be pivotable about a right/left axis. To the leading end of the arm, a bucket is pivotally connected to be pivotable about a right/left axis. And, on the right and left opposed sides of the frame, outriggers are attached. Then, these components, i.e. the swing bracket, the boom, the arm, the bucket, the outriggers, are all operated by means of hydraulic cylinders. Further, a separate step is mounted above an upper wall of the frame, and on this step, there is fixedly mounted a control box which accommodates therein a control valve unit comprised of an assembly of control valves for controlling the respective hydraulic cylinders for operating the swing bracket, the boom, the arm, the bucket, and the outriggers (see JP-A-2003-20674 and JP-A-2000-345582).

According to another known tractor with a backhoe of the above type, the boom cylinder for operating the boom is inserted in the boom and one end of the boom cylinder is pivotally connected to a rear upper portion of the swing bracket. The arm cylinder for operating the arm is disposed on the upper side of the boom and along this boom. The bucket cylinder for operating the bucket is disposed on the rear face side of the arm and along this arm. Hydraulic hoses for feeding pressure oil to these hydraulic cylinders are arranged from the rear face of the control valve unit to the rear side. Then, the hoses are extended between a boom cylinder pivot portion provided at the rear upper portion of the swing bracket and the pivot portion of the swing bracket relative to the frame, and then between the boom cylinder pivot portion and the boom pivot portion to be inserted eventually into the boom (see JP-A-2000-345582).

With such tractor with a backhoe, generally, it is possible to e.g. stabilize the work by drawing the work device having the boom, the arm and the bucket as forward as possible (i.e. as close to the tractor as possible) by drawing the base portion of the boom as forward as possible (i.e. as close to the tractor as possible). However, with the conventional construction described above, the control valve unit is disposed on the upper side of the frame and the hydraulic hoses for the boom cylinder, the arm cylinder, and the bucket cylinder are extended between the boom cylinder pivot portion provided at the rear upper portion of the swing bracket and the pivot portion of the swing bracket relative to the frame, and then between the boom cylinder pivot portion and the boom pivot portion to be inserted eventually into the boom. This construction requires securing of a space for inserting the hydraulic hoses between the boom cylinder pivot portion and the swing bracket pivot portion. This requirement imposes limit in drawing the base portion of the boom forward, or close to the tractor.

SUMMARY OF THE INVENTION

In view of the above-described state of the art, an object of the present invention is to provide a tractor with a backhoe, which allows the base portion of the boom to be disposed more forwardly (toward the tractor) than the conventional construction.

For accomplishing the above-noted object, according to the present invention, a tractor with a backhoe, the backhoe being mounted to a rear portion of the tractor and having a boom, an arm pivotally supported to a leading end of the boom, a bucket pivotally supported to a leading end of the arm, a boom cylinder for operating the boom, an arm cylinder for operating the arm and a bucket cylinder for operating the bucket, said tractor comprises:

a frame attached to a rear portion of the tractor, a swing bracket supported to a rear portion of the frame to be pivotable about a vertical axis;

a control valve unit having control valves for controlling the boom cylinder, the arm cylinder and the bucket cylinder; and a hose unit for feeding pressure oil from the control valve unit to the boom cylinder, the arm cylinder and the bucket cylinder;

wherein said swing bracket includes a first opening open to the front side and a second opening open to the rear side;

said control valve unit is disposed, in its plan view, on an extension line of said first opening and said second opening, said hose unit extending substantially linearly from said control valve unit through said first opening to said second opening.

With this construction, there is no need of securing a space for insertion of the hydraulic hoses between the boom cylinder pivot portion provided at the rear upper portion of the swing bracket and the pivot portion of the swing bracket relative to the frame. Therefore, the base portion of the boom can be drawn to more forwardly (i.e. closer to the tractor).

According to one preferred embodiment of the invention, said frame includes an upper wall, a lower wall spaced downwardly of the upper wall, and a vertical wall disposed from the upper wall to the lower wall for interconnecting the upper and lower walls so that front and rear faces of the vertical wall are oriented in the fore and aft direction; and wherein said control valve unit is disposed between the upper wall and the lower wall of the frame. The control valve unit can be attached to e.g. the vertical wall of the frame. Conveniently, the upper wall of the frame can be formed as a step.

According to one preferred embodiment of the present invention, said frame includes, at a rear portion thereof, a pair of upper and lower swing bracket pivot portions, said swing bracket includes, at a front portion thereof, a pair of upper and lower pivoted portions corresponding to said upper and lower swing bracket pivot portions, respectively; and said first opening is provided between said upper swing bracket pivot portion and pivoted portion and said lower swing bracket pivot portion and pivoted portion.

According to one preferred embodiment of the invention, said swing bracket includes, at a rear portion thereof, a boom pivot portion for pivotally supporting the base of the boom, and a boom cylinder pivot portion disposed upwardly of the boom pivot portion for pivotally supporting the base of the boom cylinder; and wherein said second opening is provided between said boom pivot portion and said boom cylinder pivot portion. Preferably, said boom pivot portion has a lateral shaft for vertically pivotally supporting the boom, and said hose unit extends above said lateral shaft. Preferably, said hose unit includes a boom hydraulic hose, an arm hydraulic hose and a bucket hydraulic hose which are juxtaposed along the right and left direction within the boom.

According to one preferred embodiment of the present invention, said frame includes an upper wall; a lower wall downwardly spaced from the upper wall; a vertical wall disposed from the upper wall to the lower wall for interconnecting the upper and lower walls so that front and rear faces of the vertical wall are oriented in the fore and aft direction; and right and left side walls extending forwardly from right and left ends of the vertical wall; and wherein each right/left outer portion of each said side wall including an outrigger frame for attaching an outrigger; each said outrigger frame having a pair of front and rear walls spaced apart in the fore and aft direction and connecting walls for connecting right/left inner ends of said front and rear walls; said upper wall and said lower wall each being formed of a flat plate, said vertical wall and each said side wall each being formed by bending a plate member into an angular hooked shape, said front and rear walls and said connecting wall of the outrigger frame each being formed by bending a plate member into an angular hooked shape.

Further and other features and advantages resulting from such features of the present invention will become apparent upon reading the following detailed description of the preferred embodiments of the invention with reference to the accompanying drawings.

DESCRIPTION OF THE PREFERRED EMBODIMENTS

Next, one preferred embodiment of the present invention will be described. In the following description, unless indicated otherwise, the languages of a fore and aft direction, a right/left direction and a vertical direction will all be used with reference to the forward traveling direction of the vehicle body.

Figure 1:
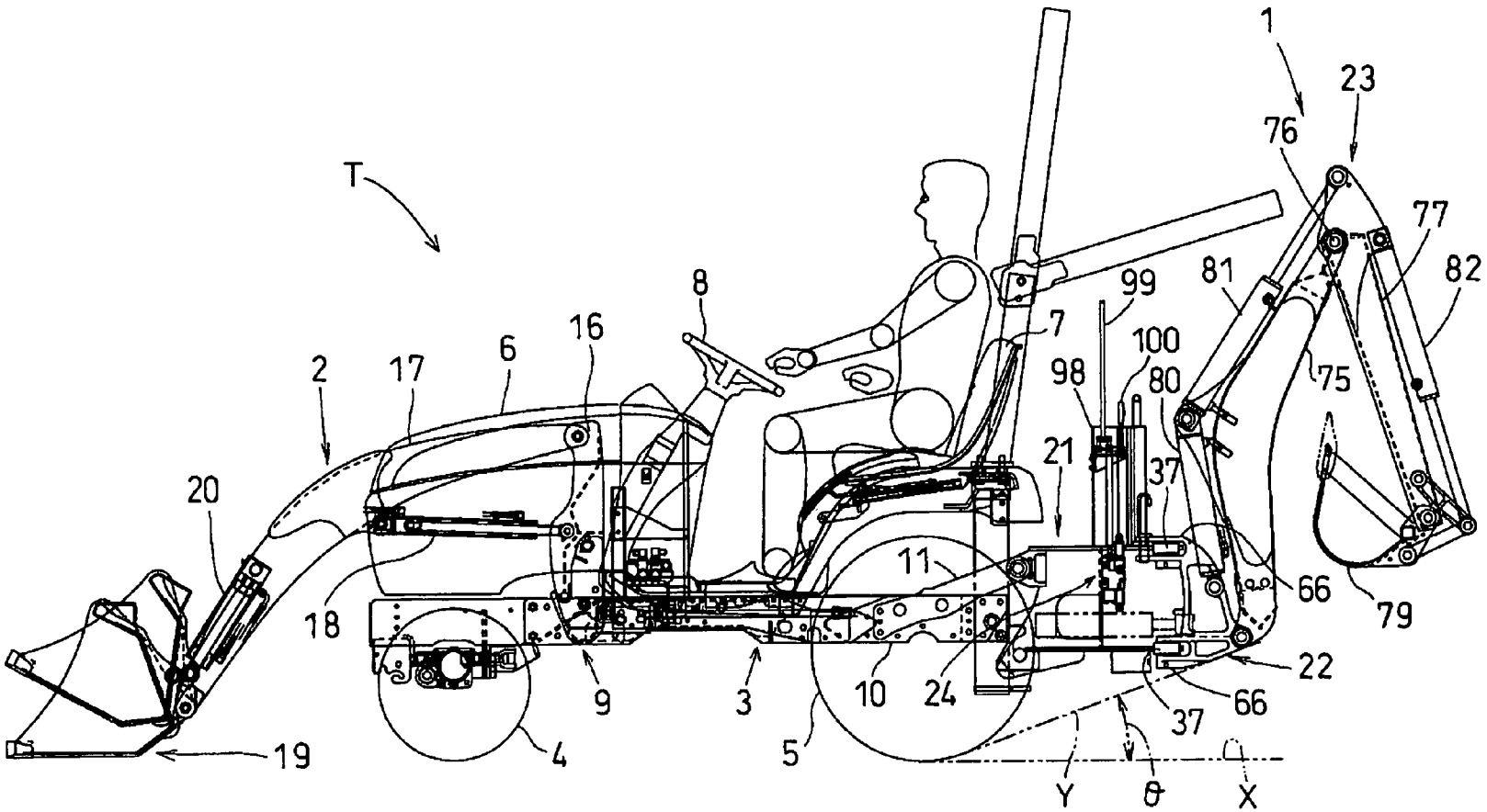
FIG. 1 is an overall side view of a tractor with a backhoe according to one embodiment of the present invention, showing the tractor having also a front loader mounted thereto in addition to the backhoe.
Figure 2:
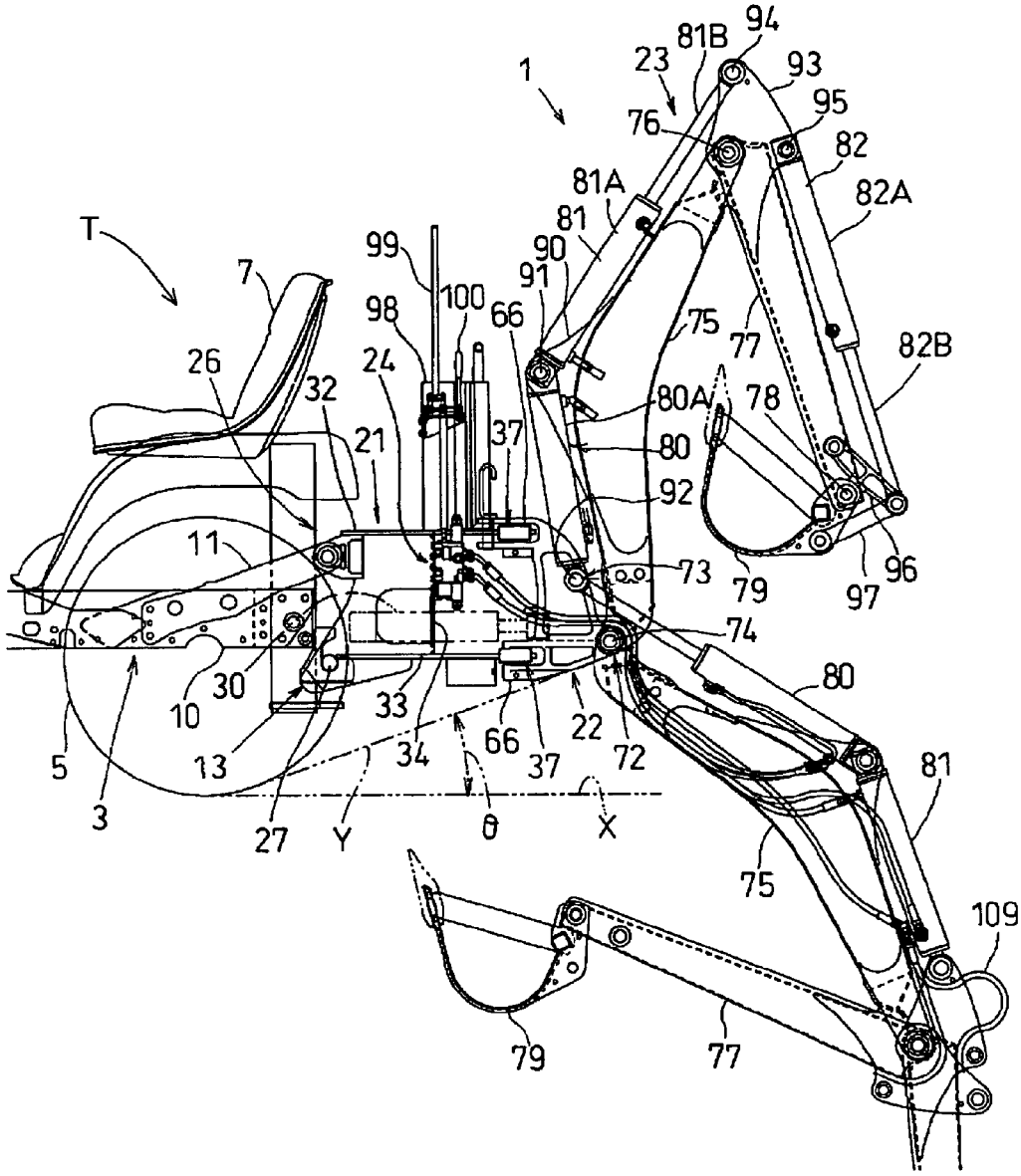
FIG. 2 is a side view showing principal portions in FIG. 1.

In FIG. 1 and FIG. 2, mark T denotes a tractor. Numeral 1 denotes a backhoe attached to the rear portion of the tractor T. Numeral 2 denotes a front loader optionally attached to the front portion of the tractor T. Numeral 3 denotes an attaching frame mounted on the vehicle body of the tractor T for attaching the backhoe 1 and the front loader 2 thereto.

The tractor T employed herein is a two-shaft, four-wheel tractor having a pair of right and left front wheels 4 and a pair of right and left rear wheels 5. Though not shown, the vehicle body of this tractor T consists mainly of an engine mounted at a forward position thereof, a clutch housing connected to a rear side of the engine via a flywheel housing, and a transmission case connected to a rear side of the clutch housing. The engine is covered by a hood 6, and a driver's seat 7 is provided upwardly of the transmission case (at a rear upper portion of the vehicle body). A steering wheel 8 is provided forwardly of the driver's seat 7.

The driver's seat 7 is adapted to be switchable in its posture between a forwardly oriented posture for driving the tractor T and operating e.g. the front loader 2, and a rearwardly oriented posture for operating the backhoe 1.

Incidentally, the backhoe 1 may include a further driver's seat for its own.

The attaching frame 3 includes loader attaching portions 9 disposed and fixed on the right and left sides of the front portion of the tractor T, main frames 10 disposed and fixed on the right and left sides of the tractor vehicle body, and auxiliary frames 11 extending rearwardly and upwardly from the rear portions of the right and left main frames 11. An upper connecting portion 12 is provided on the rear end side of each of the right and left auxiliary frames 11, and a lower connecting portion 13 is provided on the rear end side of each of the right and left main frames 10.

Figure 5:
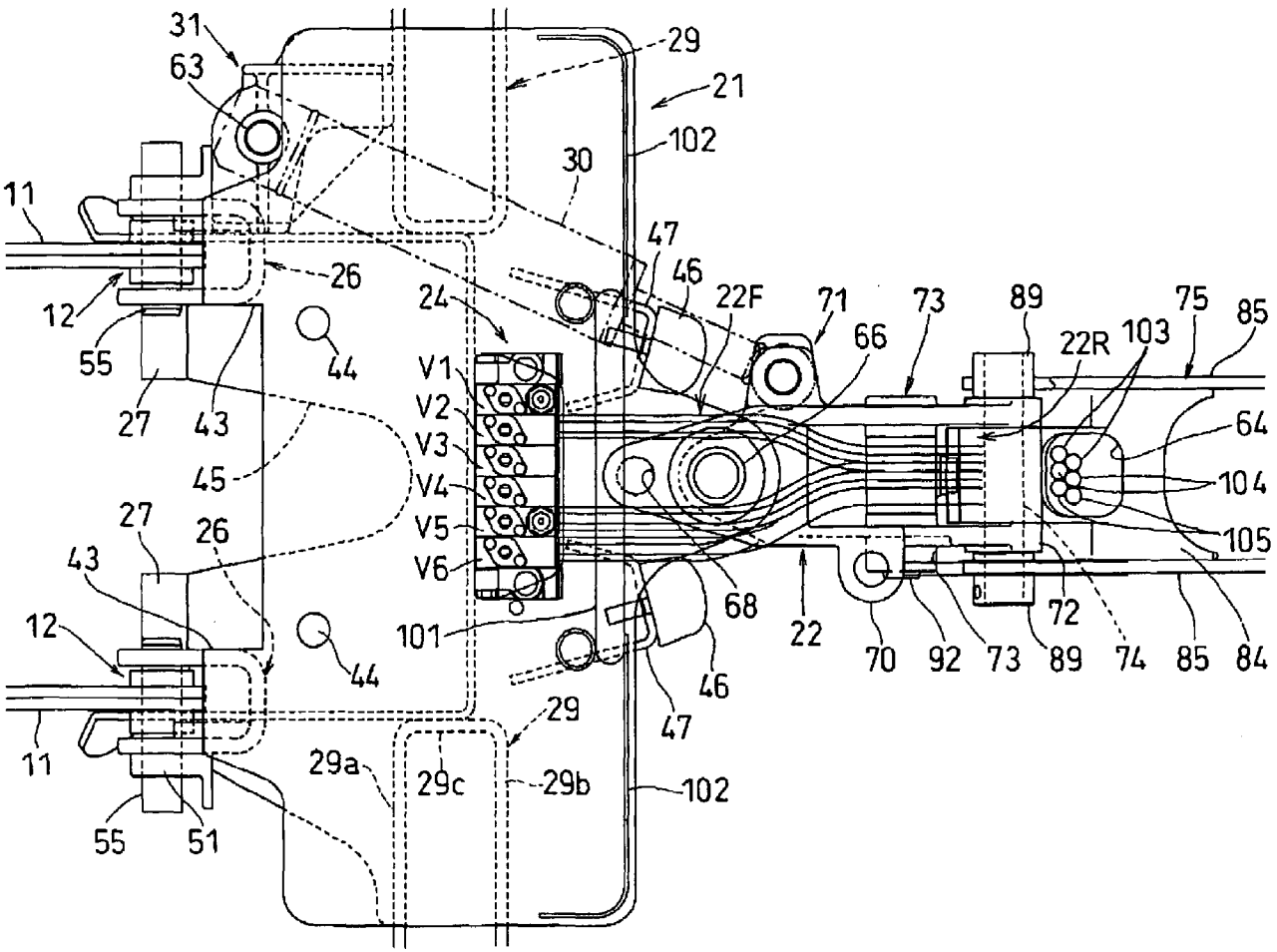
FIG. 5 is a plan view showing principal portions in FIG. 4.
Figure 6:
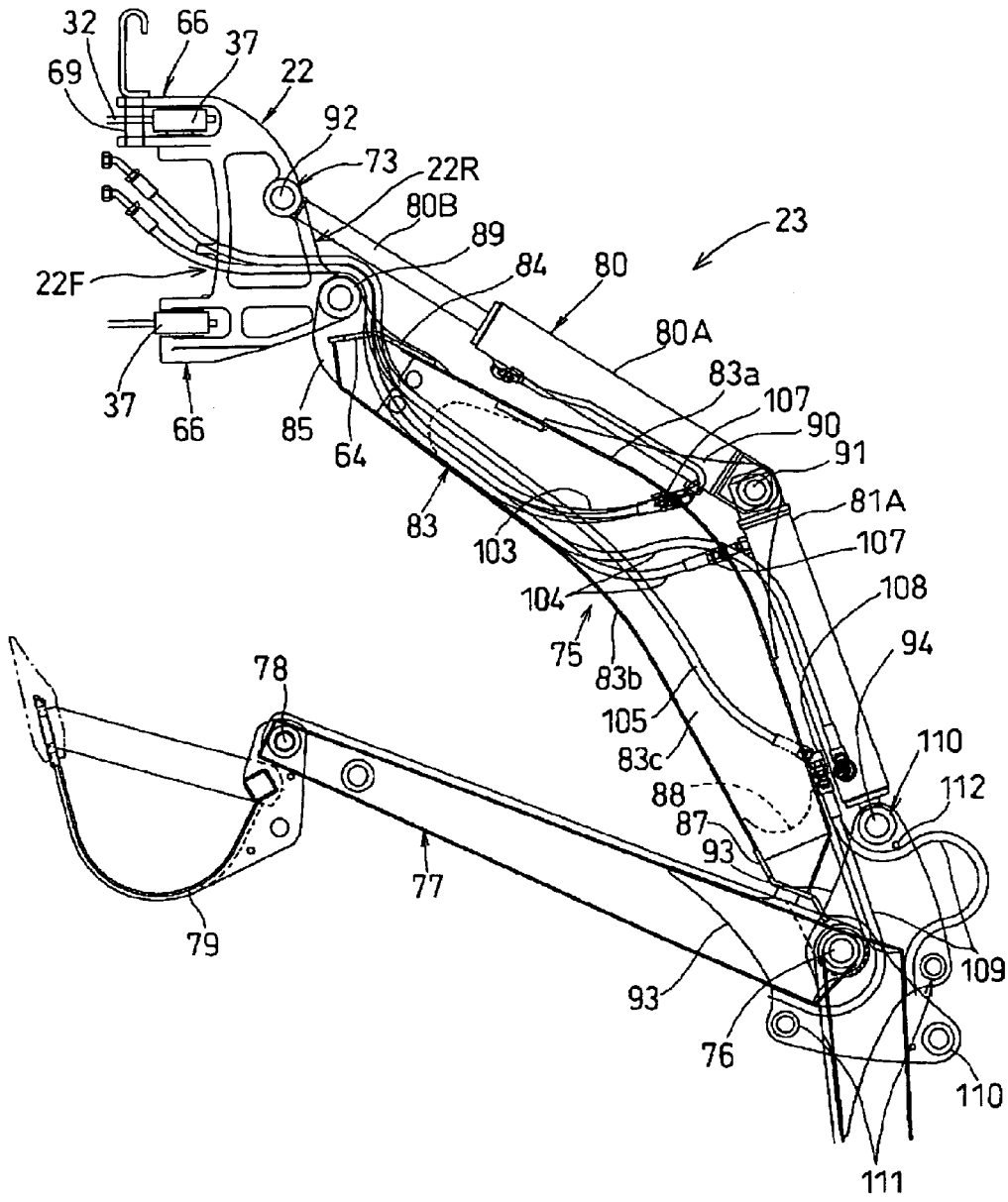
FIG. 6 is a side view showing an excavator of the backhoe.
Figure 7A:
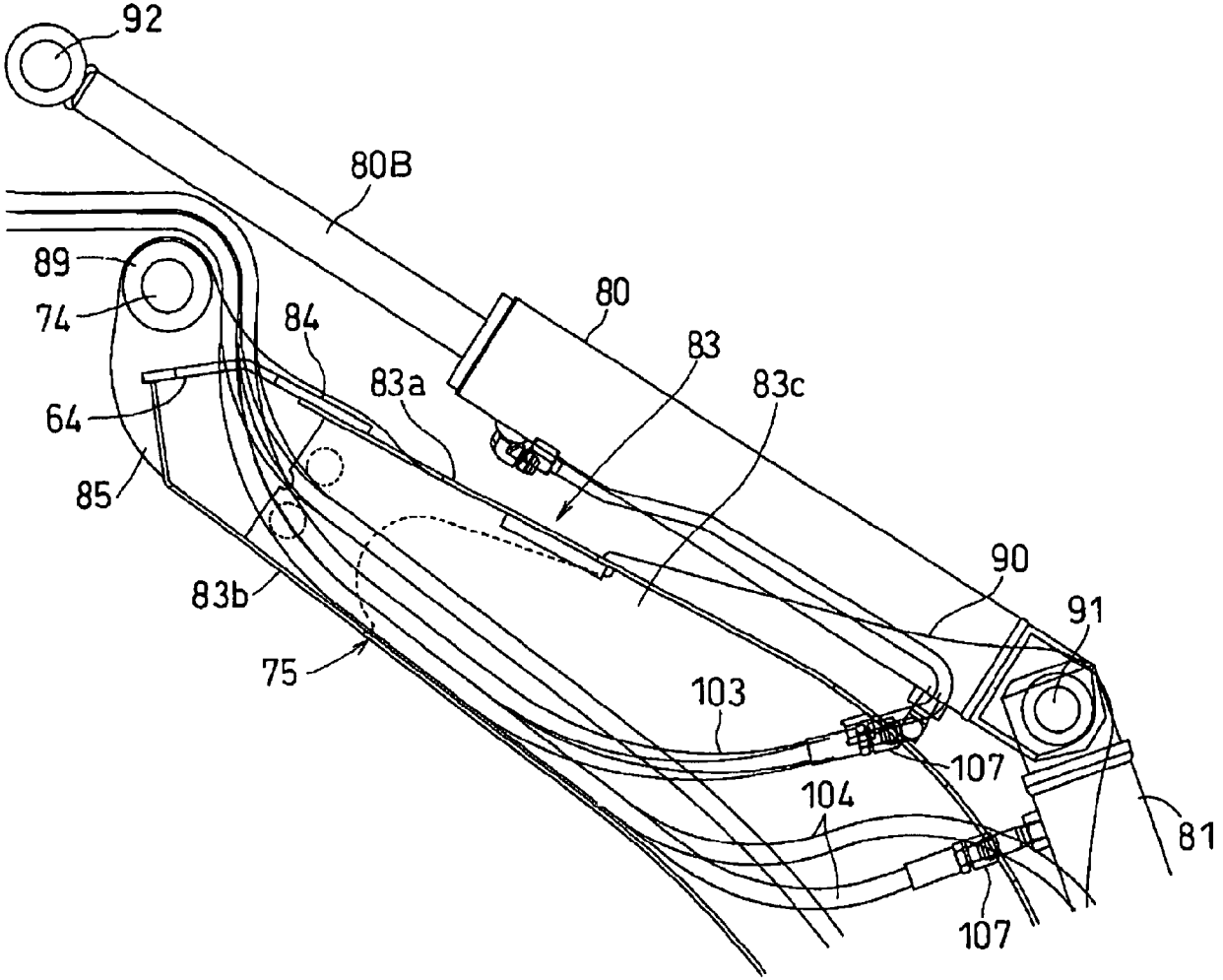
FIG. 7A is a side view of a base portion of a boom.
Figure 7B:
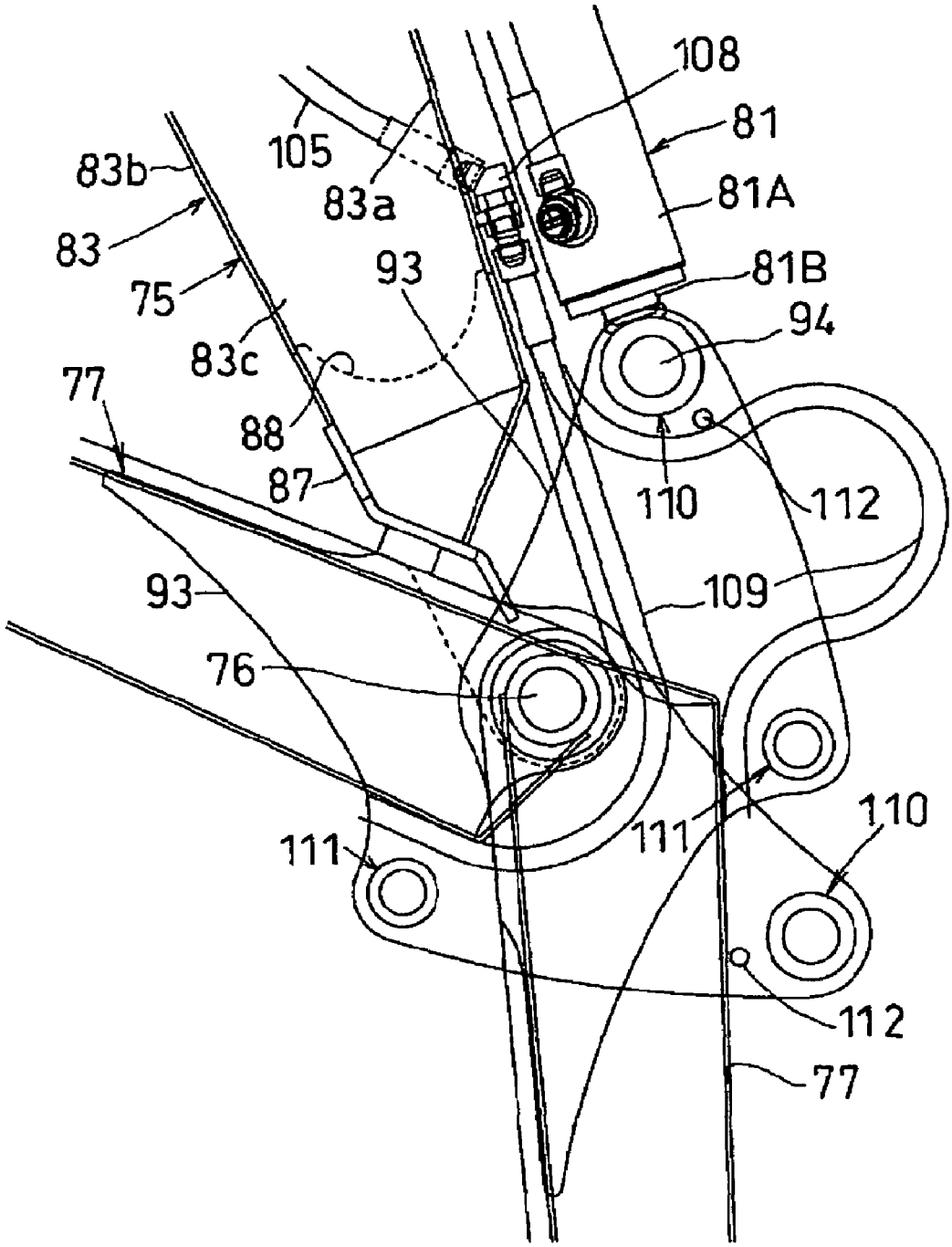
FIG. 7B is a side view showing a leading end of the boom.
Figure 8:
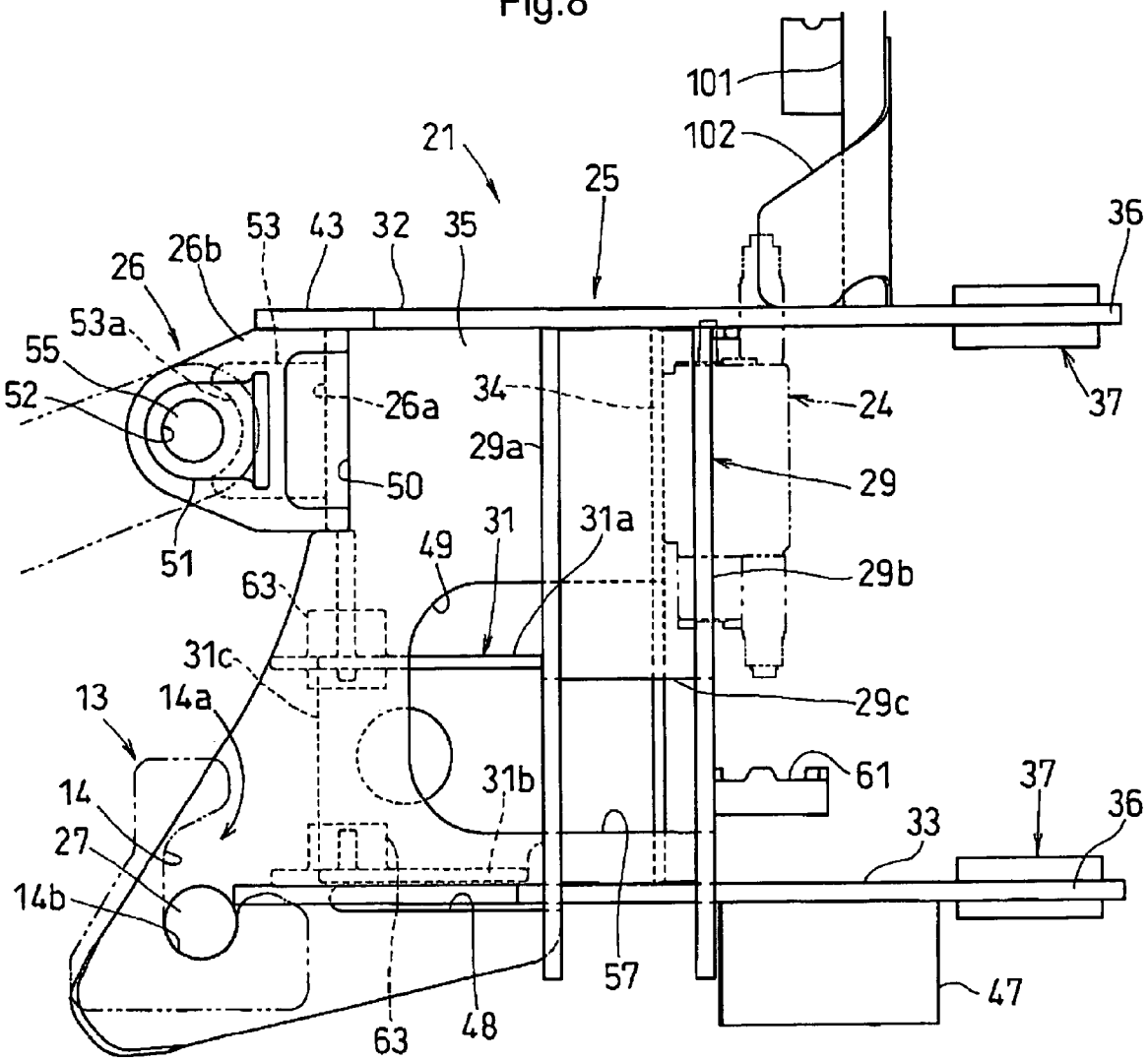
FIG. 8 is a side view of a backhoe attaching frame.
Figure 9:
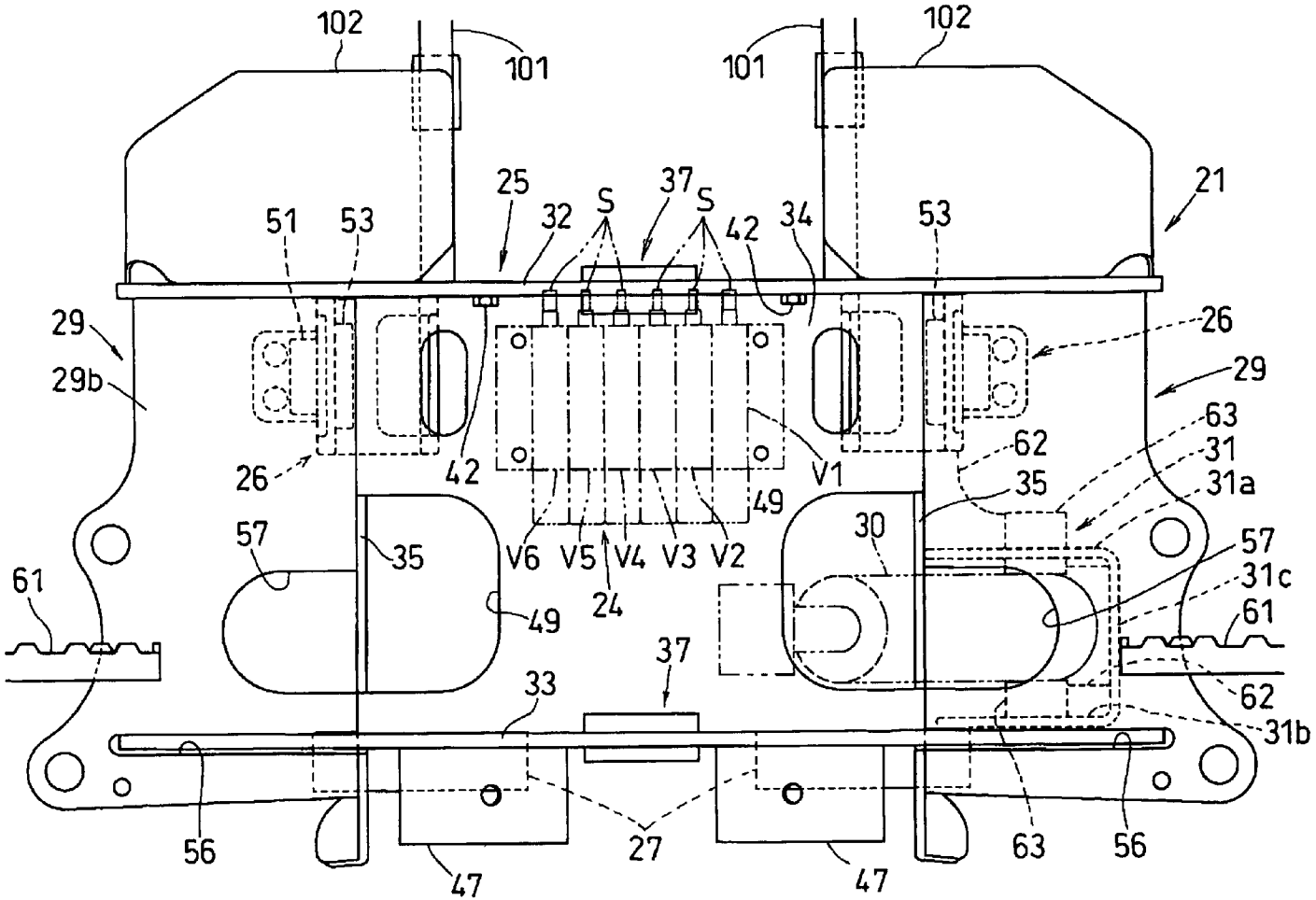
FIG. 9 is a rear view of the backhoe attaching frame.
Figure 10:
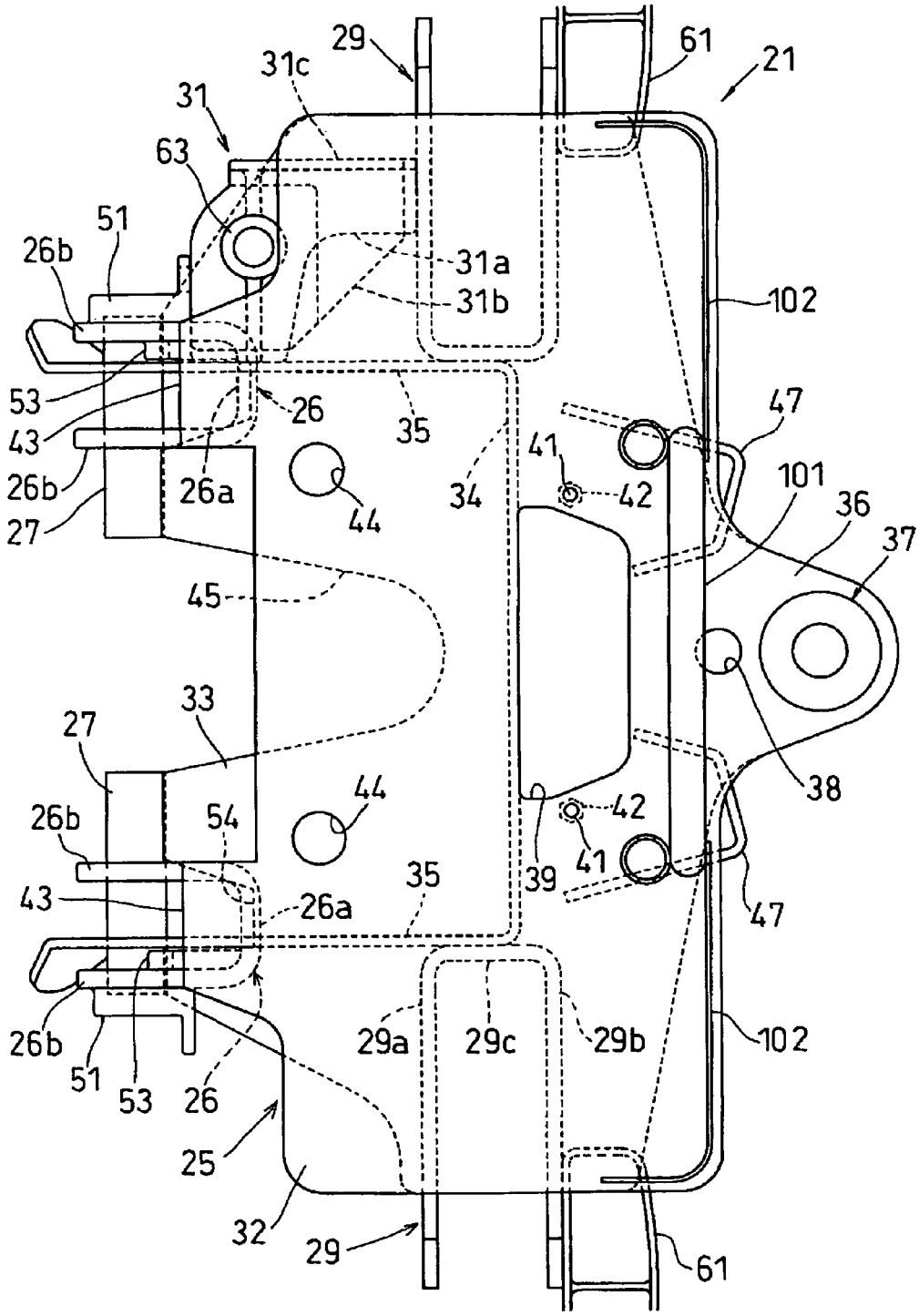
FIG. 10 is a plan view of the backhoe attaching frame.
Figure 11:
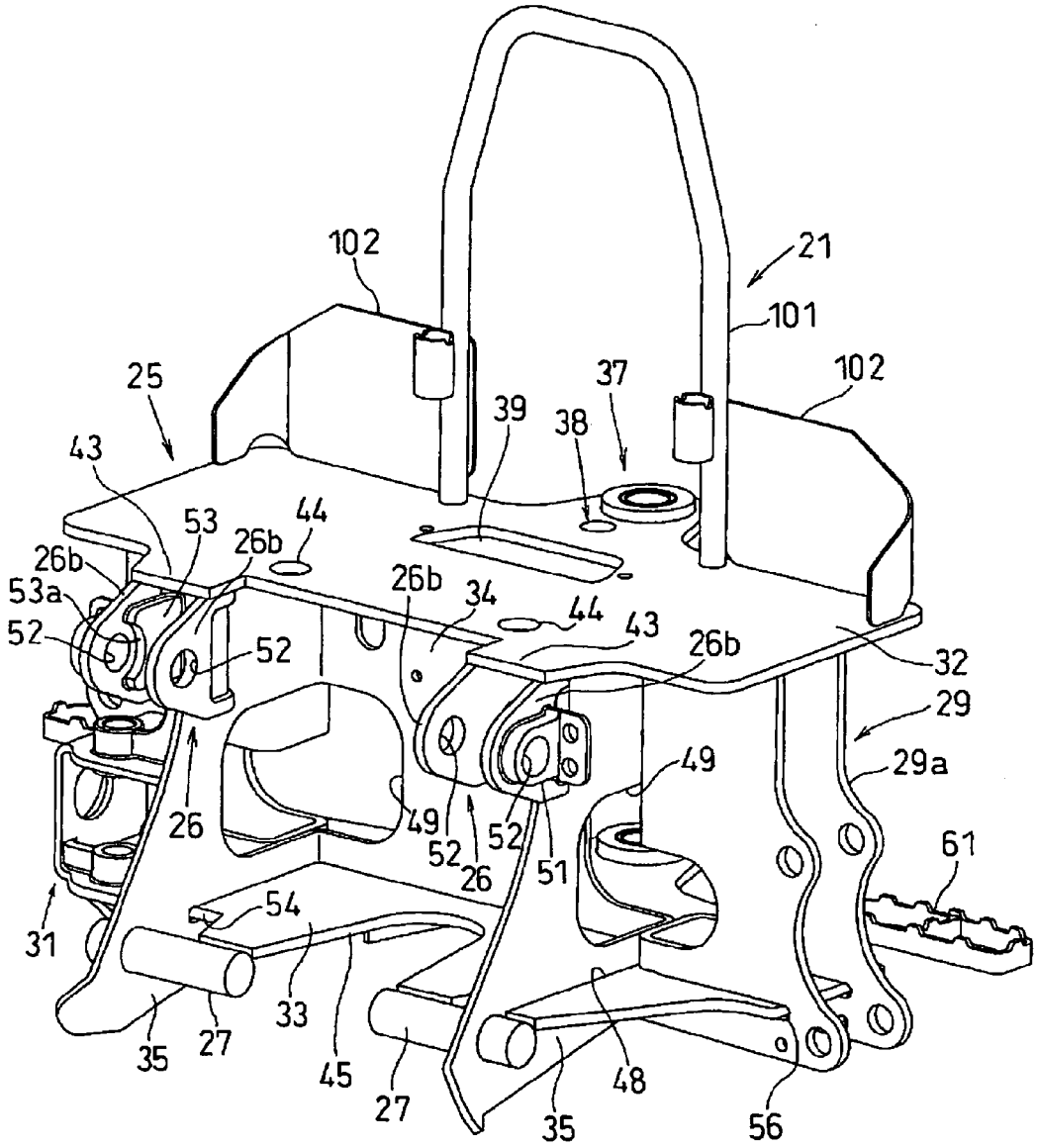
FIG. 11 is a perspective view showing the backhoe attaching frame as seen from its front side.
Figure 12:
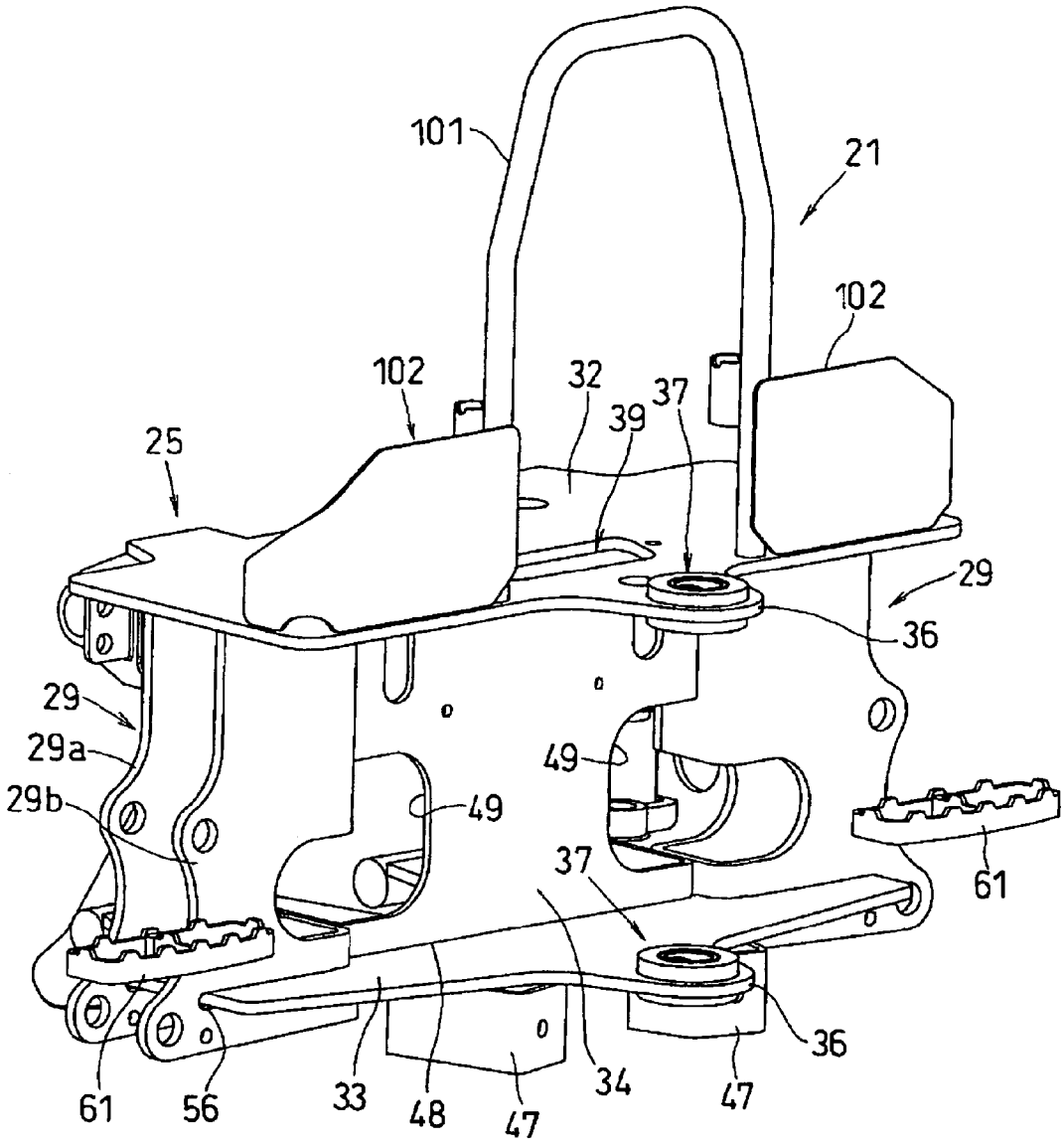
FIG. 12 is a perspective view showing the backhoe attaching frame as seen from its rear side.

The upper connecting portion 12, as shown in FIG. 5, is formed of a cylindrical member having a right/left axis. The lower connecting portion 13, as shown in FIG. 8, is formed of a thick plate having an engaging groove 14. This engaging groove 14 consists of a rearwardly open inserting/withdrawing portion 14*a* and an upwardly open semi-circular receiving portion 14*b* disposed downwardly of the inserting/withdrawing portion 14*a*.

The front loader 2 includes a pair of right and left side frames 16 detachably attached to the loader attaching portions 9; a pair of right and left booms 17 pivotally connected to the upper ends of the side frames 16 to be pivotable about the right/left axis; and a pair of right and left boom cylinders 18 interposed between the side frames 16 and the booms 17 for vertically pivoting the booms 17. Further, to the leading ends of the right and left booms 17, a bucket 19 is pivotally connected to be pivotable about a right/left axis. And, between a connecting member interconnecting the right and left booms 17 and the bucket 19, there is interposed a bucket cylinder 20 for pivoting the bucket 19.

As shown in FIG. 1 through FIG. 7B, the backhoe 1 includes a backhoe attaching frame (referred to simply as "frame" hereinafter) 21 detachably attached to the attaching frame 3, a swing bracket 22 provided at a rear portion of the frame 21, an excavator 23 supported to the swing bracket 22, and a control valve unit 24 comprising an assembly of control valves for controlling hydraulic cylinders mounted on the backhoe 1. The swing bracket 22 includes a first opening 22F open to the front side and a second opening open 22R to the rear side.

Figure 3:
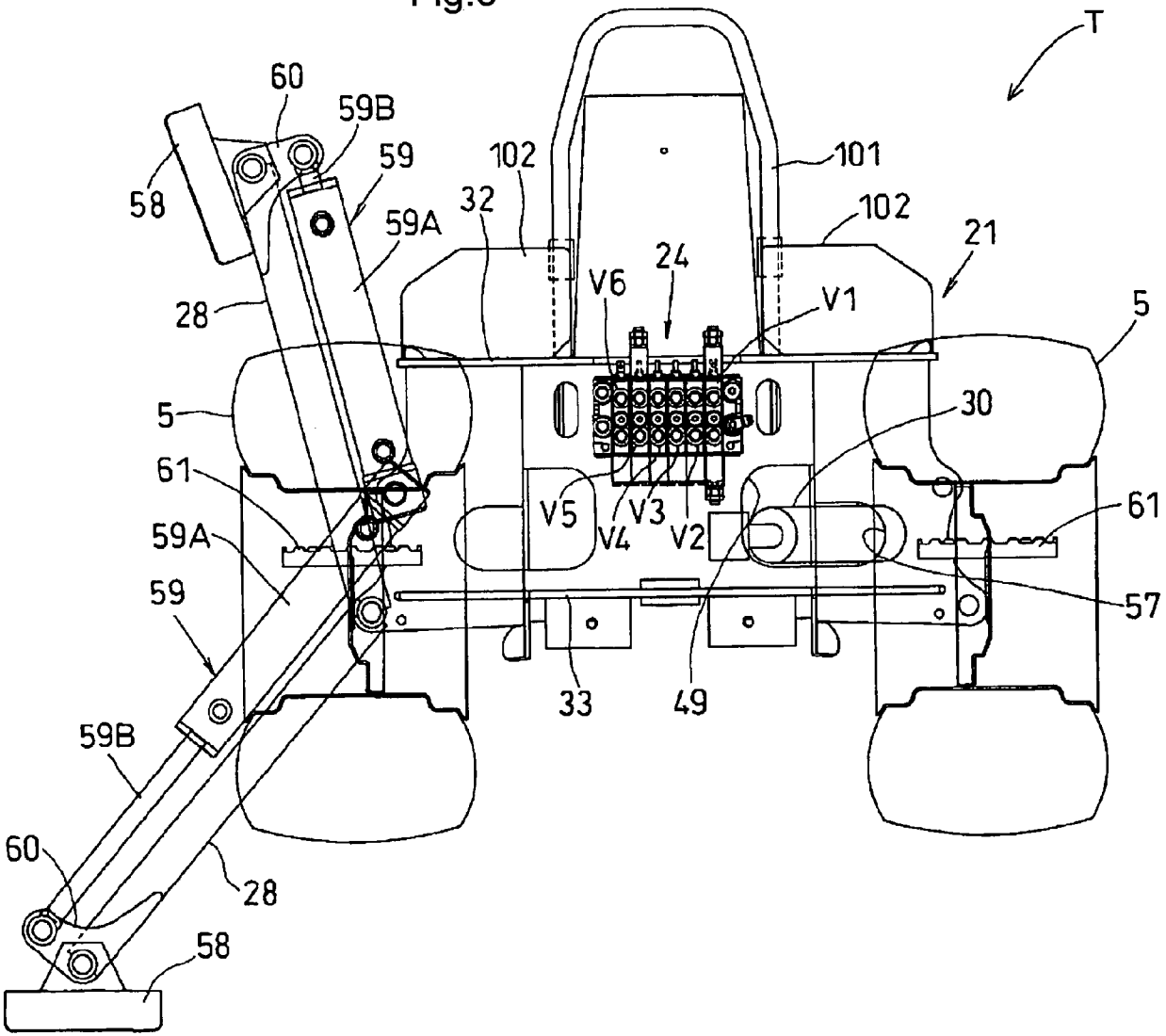
FIG. 3 is a rear view of the tractor, with the backhoe being detached therefrom.
Figure 4:
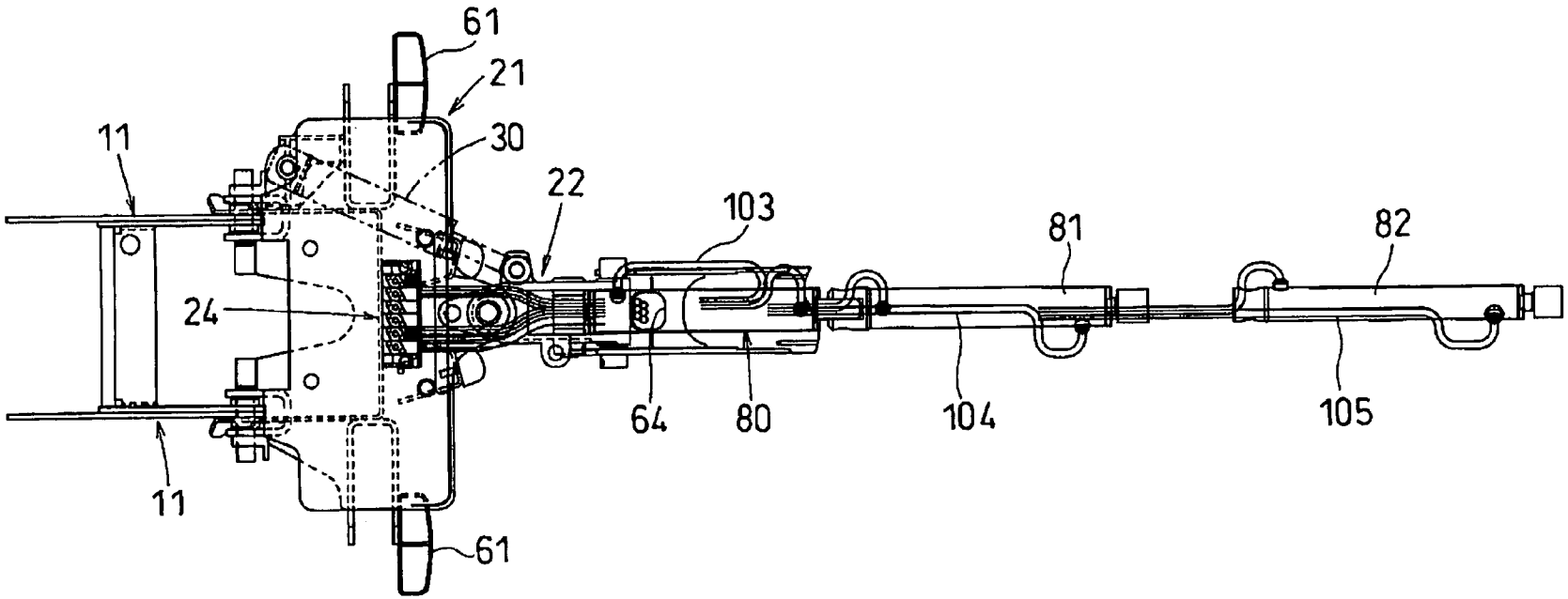
FIG. 4 is a plan view of the tractor with the backhoe shown in FIG. 1.

The frame 21, as shown in FIGS. 8-12, includes a main frame 25, upper and lower connected portions 26, 27 for attaching this main frame 25 to the attaching frame 3, a pair of right and left outrigger frames 29 for attachment of outriggers 28 (one of them is shown in FIG. 3) and a cylinder attaching frame 31 for pivotally connecting a swing cylinder 30 for pivoting the swing bracket 22, with all these members being welded together.

The main frame 25 includes an upper wall 32; a lower wall 33 downwardly spaced from the upper wall 32; a vertical wall 34 disposed from the upper wall 32 to the lower wall 33 for interconnecting the upper and lower walls 32, 33 so that front and rear faces of the vertical wall 34 are oriented in the fore and aft direction; and right and left side walls 35 extending forwardly from right and left ends of the vertical wall 34 and interconnecting the upper and lower walls 32, 33.

With this frame 21, there is not separately provided any step acting as e.g. a foot step for the driver during driving. Instead, the upper wall 32 of the main frame 25 is formed as such a step.

The upper wall 32 and the lower wall 33 are formed of flat plates. At the right/left center portions of the rear ends of these upper and lower walls 32, 33, there are provided extension portions 36 which extend rearwards. For these upper and lower extension portions 36, there are provided swing bracket pivot portions 37. Each swing bracket pivot portion 37 comprises a cylindrical member having a vertical axis and vertically extending through the upper wall 32 or the lower wall 33 and fixedly welded to the upper wall 32 or the lower wall 33.

At a portion of the upper wall 32 forwardly of the swing bracket pivot portion 37, there is formed a pin insertion hole 38 and forwardly of this pin insertion hole 38 and rearwardly of the vertical wall 34, there is formed an opening 39 vertically extending therethrough. And, on right and left sides of this opening 39, there are formed bolt insertion holes 41, and nuts 42 aligned with the axes of the bolt insertion holes 41 are fixedly welded to the lower side of the upper wall 32.

Further, at a front end of the upper wall 32 and upwardly of the right and left side walls 35, there are formed forwardly extending reinforcing portions 43, and adjacent each reinforcing portion 43, there is formed a lock pin retaining hole 44.

At the right/left center of the lower wall 33 and a concave portion 45 is recessed from its front end, extending rearward to a position before the vertical wall 43.

Further, to the rear lower side of the lower wall 33, there are provided a pair of right and left brackets 47 for attaching contact members 46 which come into contact with the swing bracket 22 when this bracket 22 is pivoted to the right/left.

The vertical wall 34 and the right and left side walls 35 each is formed integrally by bending a plate member into an angular hook shape in its plan view.

The vertical wall 34 is disposed between the upper and lower walls 32, 33, with the upper end thereof contacting the lower face of the upper wall 32 and the lower end thereof contacting the upper face of the lower wall 33.

Each of the right and left side walls 35 has its upper end contacting the lower face of the upper wall 32 and a rear portion of its lower end contacting the upper face of the lower wall 33. The lower portion of each side wall 35 extends, at its fore and aft intermediate portion to its front end, downwardly of the lower wall 33. Further, at a lower portion of this side wall 35, there is formed an insertion hole 48 extending from an intermediate portion toward the front portion, the insertion hole 48 receiving insertion of the lower wall 33 in order to avoid interference with this lower wall 33.

Further, the lower front end portion of the right/left side wall 35 is bent with such an inclination that the portion extends outward in the right/left direction toward its front side.

At the right and left opposed sides of the lower portion of the vertical wall 34, there are formed a pair of right and left cutouts 49 which are cut out to extend from the vertical wall 34 to the side wall 35. And, at the front edge upper portion of each of the right and left side walls 35, there is formed an engaging recess 50.

Each of the right and left upper connected portions 26 includes a rear wall portion **26*a* and a right/left side wall portion 26*b* and is comprised mainly of a plate member bent to present an angular hook shape in its plan view, and the rear end portion thereof being engaged with the upper engaging recess 50 formed at the upper portion of the side wall 35 of the main frame 25**.

The rear face of the rear wall portion **26*a* of this upper connected portion 26 contacts the front edge of the side wall 35 of the main frame 25 and the rear upper ends of the right and left side wall portions 26*b* and the upper end of the rear wall portion 26*a* contact the lower face of the reinforcing portions 43 of the upper wall 42 of the main frame 25**.

The front portion of each right/left side wall portion **26*b* of this upper connected portion 26 projects forwardly from the reinforcing portion 43 of the upper wall 32 of the main frame 25, and to an outer face of the outer side wall portion 26*b* at this projecting portion, a reinforcing member 51 is fixedly welded, and across this reinforcing member 51 and each right/left side wall portion 26*b*, there is formed a pin insertion hole 52** having a right/left axis.

Further, to the inner side of the outer side wall portion **26*b* of the upper connected portion 26 too, a reinforcing member 53 is provided. This reinforcing member 53 is disposed on the rear side of the pin insertion hole 52. On the front face of this reinforcing member 53, there is formed an arcuate receiving face 53*a* centering about the center of the pin insertion hole 52**.

Each of the right and left lower connected portions 27 is formed of a pin having a right/left axis. Each of these right and left lower connected portions 27 extends through a front lower portion of the right/left side wall 35 of the main frame 25 and is fixedly welded to this side wall 35 and is disposed substantially immediately under the pin insertion hole 52 of the upper connected portion 26.

Further, at right and left opposed sides of the lower wall 33 of the main frame 25, there are formed cutout concave portions 54 in the form of forked shape formed concave from the front end to the rear side, with the front end of the forked portion being fixedly welded to the lower connected portions 27.

In each lower connected portion 27, a portion thereof corresponding to the cutout concave portion 54 is inserted through an inserting portion **14*a* into the engaging groove 14 of the lower connecting portion 13 of the attaching frame 3 and engaged in the receiving portion 14*b*. Between the right and left side wall portions 26*b* of the upper connected portion 26, the upper connecting portion 12 of the attaching frame 3 is inserted and this upper connecting portion 12 contacts a receiving face 53*a* of the reinforcing member 53 on the inner side of the upper connected portion 26. Under this condition, a lock pin 55 inserted through the pin insertion hole 52 to the upper connecting portion 12 and retained against withdrawal by means of an unillustrated stopper pin. With this, the frame 21 of the backhoe 21 is detachably attached to the attaching frame 3**.

Incidentally, when the backhoe 1 is to be detached, the lock pin 55 will be retained as being inserted into the lock pin retaining hole 44 of the upper wall 32 of the main frame 25.

Each outrigger frame 29 includes front and rear walls **29*a*, 29*b* spaced from each other in the fore and aft direction and a connecting wall 29*c* interconnecting right/left inner ends of these front and rear walls 29***a*, 29*b*, and the frame 29 is formed by bending a plate member into an angular hook shape in its plan view.

This outrigger frame 29 has a vertical width extending from the upper wall 32 to the lower wall 33 of the main frame 25, with a lower end thereof extending downwardly of the lower wall 33 of the main frame 25, and at the lower end of the outrigger frame 29, an insertion groove 56 for receiving this lower wall 33 is formed from the connecting wall 29*c* to the front and rear walls 29*a*, 29*b* in order to avoid interference with the lower wall 33. The connecting wall 29*c* contacts the outer side of the side wall 35 of the main frame 25 and upper ends of the connecting wall 29*c* and the front and rear walls 29*a*, 29*b* contact the lower face of the upper wall 32 of the main frame 25.

Further, at a lower portion of the outrigger frame 29, there is formed a cutout 57 disposed upwardly of the insertion groove 56 and extending from the connecting wall 29*c* to the front and rear walls 29*a*, 29*b*.

At the lower end portion of this outrigger frame 29 between the front and rear walls 29*a*, 29*b*, one end of the outrigger 28 is pivotally connected to be pivotable about a fore and aft axis. To the other end of the outrigger 28, a ground contact member 58 is pivotally, connected. On the upper side of the outrigger 28, there is disposed substantially in parallel therewith, an outrigger cylinder 59 comprised of a hydraulic cylinder. A piston top side end of a cylinder body 59A of this outrigger cylinder 59 is disposed at a vertically intermediate portion between the front and rear walls 29*a*, 29*b* of the outrigger frame 29 and pivotally connected to these front and rear walls 29*a*, 29*b* to be pivotable about a fore and aft axis. The leading end of a piston rod 59B of this outrigger cylinder 59 is pivotally connected to a bracket 60 which is secured to the other end of the outrigger 28. In operation, in association with extension/contraction of the outrigger cylinder 59, the outrigger 28 is vertically pivoted. (See FIG. 3 also.)

Further, at a lower portion of the rear face of the rear wall of the outrigger frame 29, there is fixedly welded an auxiliary step 61 which projects outward in the right/left direction.

The cylinder attaching frame 31 is disposed on the outer side in the right/left direction of the right side wall 35 of the main frame 25 and forwardly of the front wall 29*a* of the right outrigger frame 29 and upwardly of the lower wall 33. And, this frame 31 includes an upper wall portion 31*a*, a lower wall portion 31*b* downwardly spaced from the upper wall portion 31*a* and a connecting wall portion 31*c* interconnecting right/left outer ends of these upper and lower wall portions. And, the frame is formed by bending a plate member into an angular hook shape in its front view.

Numeral 62 denotes a reinforcing rib.

Each of the upper and lower walls 32, 33 includes a swing cylinder pivot portion 63 formed of a cylindrical member having a vertical axis, and between these upper and lower swing cylinder pivot portions 63, the piston top end portion of the cylinder body 30A of the swing cylinder 30 comprised of a hydraulic cylinder is disposed and pivotally connected to be pivotable about a vertical axis.

Further, the swing cylinder 30 projects via the cutout 57 of the outrigger frame 29 and the cutout 49 of the main frame 25 to the front side of the vertical wall 34 of the main frame 25.

According to the conventional technique, the backhoe attaching frame is formed by fixedly welding flat plates together into a box shape in order to ensure sufficient strength. This construction requires a large number of components and suffers poor productivity due to significant welding lengths required. Moreover, as this construction does not allow elimination of inner side welding, the welding cannot be carried out by a robot.

On the other hand, according to the present invention, each of the vertical wall 35 and the right and left side walls 35 of the main frame 25 is formed by bending a plate member into an angular hook shape and also such other components as the outrigger frame 29 and the cylinder attaching frame 31 too are each formed by bending a plate member into an angular hook shape. And, by welding these components together, the frame 21 of the backhoe 1 is constructed. With this, the number of components and the welding lengths can be reduced advantageously and also as the need for inner side welding has been eliminated, the robot welding operation is made possible for major welding operations except for temporary attachment. Further, sufficient strength can be ensured also.

With reference also to FIGS. 1-7B hereinafter, in the swing bracket 22, at the right/left center portion at the front portion, there are provided a pair of upper and lower pivoted portions 66, with the upper pivoted portion 66 being pivotally connected to the upper swing bracket pivot portion 37 of the frame 21 to be pivotable about a vertical axis, the lower pivoted portion 66 being pivotally connected to the lower swing bracket pivot portion 37 of the frame 21 to be pivotable about a vertical axis. With these, the swing bracket 22 is supported to the rear portion of the frame 21 to be pivotable in the right/left direction.

Further, at a front portion of the upper pivoted portion 66, there is formed a pin insertion hole 68 and as a pin 69 is inserted through this pin insertion hole 68 and the pin insertion hole 38 of the main frame 25, it is possible to restrict the right/left pivotal movement of the swing bracket 22 when the swing bracket 22 is oriented rearward.

Incidentally, on the left side of the swing bracket 22, there is provided a retaining portion 70 for retaining the pin 69 for restricting the right/left pivotal movement of the swing bracket 22, when the pin 69 is not used.

Further, at a lower portion on the right side of this swing bracket 22, there is provided a swing cylinder pivot portion 71. And, to this swing bracket pivot portion 71, the leading end of the piston rod of the swing cylinder 30 is pivotally connected. Then, in association with extension/contraction of the swing cylinder 30, the swing bracket 22 is pivoted to the right/left.

Further, at the lower end of the rear portion of the swing bracket 22, there is provided a boom pivot portion 72 formed of a cylindrical member having a right/left axis. And, on the front upper side of this boom pivot portion 72, there are provided a pair of right and left boom cylinder pivot portions 73 each being formed of a cylindrical member having a right/left axis.

The excavator 23 includes a boom 75 having a base portion thereof pivotally connected via a lateral shaft (this will be referred to as "first lateral shaft") 74 to the boom pivot portion 72 of the swing bracket 22 to be pivotable about a right/left axis so that the boom 75 can be vertically pivotable, an arm 77 having a base portion thereof pivotally connected via a lateral shaft (this will be referred to as "second lateral shaft") 76 to the leading end of the boom 75 to be pivotable about a right and left axis so that the arm 77 can be pivotable in the fore and aft direction, a bucket 79 pivotally connected via a lateral shaft (this will be referred to as "third lateral shaft") 78 to the leading end of boom 75, an arm cylinder 81 for pivoting the arm 77 and a bucket cylinder 82 for pivoting the bucket 79.

The boom cylinder 80, the arm cylinder 81, and the bucket cylinder 82 are all comprised of hydraulic cylinders.

The boom 75 includes a boom body 83 formed by bending cylindrical members each having a rectangular cross section in a hook shape and including upper and lower walls 83*a*, 83*b* and right and left side walls 83*c*, and a base portion of this boom body 83 is closed with an upper plate 84, the lower wall 83*b* of the boom body 83 and right and left bracket plates 85, the upper plate 84 forming a hose insertion hole 64 for introducing hydraulic hoses into the boom 75.

Further, the leading end of the boom body 83 is closed with a lower plate 87, the upper wall 83*a* of the boom body 83 and right and left bracket plates 88. And, between the right and left bracket plates 88, the base portion of the arm 77 is pivotally connected via the second lateral shaft 76.

Each of the right and left bracket plates 85 at the base end of the boom 85 includes a pivoted portion 89 comprised of a cylindrical member having a right/left axis. Between these right and left pivoted portions 89, the boom pivot portion 72 is disposed and the first lateral shaft 74 is inserted across these right and left pivoted portions 89 and the boom pivot portion 72, the base portion of the boom 75 is pivotally connected to the swing bracket 22.

At a longitudinal intermediate portion of the upper wall 83*a* of the boom body 83, there are provided a pair of right and left bracket plates 90. Between these bracket plates 90, the piston top portion of the cylinder body 80A of the boom cylinder 80 and the piston top portion of the cylinder body 81A of the arm cylinder 81 are pivotally connected via a pivot shaft 91 to be pivotable about a right/left axis.

The leading end of the piston rod 80B of the boom cylinder 80 is pivotally connected via a pivot shaft 92 to the boom cylinder pivot portion 73 of the swing bracket 22 to be pivotable about a right/left axis, and the leading end of the piston rod 81B of the arm cylinder 81 is pivotally connected via a pivot shaft 94 to an arm cylinder pivot portion 110 provided in each of the right and left bracket plates 93 provided at the base portion of the arm 77 to be pivotable about a right/left axis.

In association with extension/contraction of the boom cylinder 80, the boom 75 is vertically pivoted, and in association with extension/contraction of the arm cylinder 81, the arm 77 is pivoted in the fore and aft direction.

Between the bucket cylinder pivot portions 111 provided to the respective bracket plates 93 provided at the base portion of the arm 77, the piston top portion of the cylinder body 82A of the bucket cylinder 82 is pivotally connected via a pivot shaft 95 to be pivotable about a right/left axis. The leading end of the piston rod 82B of the bucket cylinder 82 is pivotally connected to one ends of a first link 96 and a second link 97. The other end of the first link 96 is pivotally connected to the leading end of the arm 77, whereas the other end of the second link 97 is pivotally connected to the bucket 79. Then, in association with extension/contraction of the bucket cylinder 82, the bucket is pivoted via the first and second links 96, 97.

The arm cylinder pivot portions 110 for pivotally connecting the arm cylinder 81 and the bucket cylinder pivot portions 111 for pivotally connecting the bucket cylinder 82 are disposed with a predetermined distance therebetween along the longitudinal direction of the arm 77.

Respective control valves V1-V6 together constituting the control valve unit 24 are linear spool type control valves and these control valves V1-V6 are juxtaposed and connected with each other in the direction normal to a sliding direction of spools S.

This control valve unit 24 is disposed at the right/left center portion of the rear face upper portion of the vertical wall 34 and downwardly of the opening 39 of the main frame 25 and bolt-fixed to the vertical wall 34, such that the spools S of the respective control valves V1-V6 project upward, the juxtaposing direction of these control valves V1-V6 is aligned along the right/left direction and the pressure oil ports of the respective control valves V1-V6 are open toward the rear side.

The control valves V1-V6 constituting the control valve unit 24 comprise, in the order from the right side, the swing control valve V1 for controlling the swing cylinder 30, the boom control valve V2 for controlling the boom cylinder 80, the right outrigger control valve V3 for controlling the right outrigger cylinder 59, the left outrigger control valve V4 for controlling the left outrigger cylinder 59, the arm control valve V5 for controlling the arm cylinder 81 and the bucket control valve V6 for controlling the bucket cylinder 82.

At the position of the upper wall 32 where the opening 39 is formed, there is mounted erect a control box 98, and this control box 98 is fixedly attached by means of bolts or the like which are threaded with the nuts 42 provided on the upper wall 32 of the main frame 25.

To this control box 98, there are supported a pair of right and left control levers 99 and a pair of right and left outrigger control levers 100. The right control lever 99 is a lever for operating the swing control valve V1 and the boom control valve V2. The left control lever 99 is a lever for operating the arm control valve V5 and the bucket control valve V6. The right and left outrigger control levers 100 are levers for controlling the right and left control valves. These respective control levers 99, 100 are operably coupled with the control valves V1-V6 via rods or the like connected through the opening 39 with the spools S of the valves.

Further, the right and left control levers 99 are pivotable in the fore and aft direction and in right/left direction. With a pivotal operation in the fore and aft direction, each lever controls one control valve and with a pivotal operation in the right/left direction, each lever controls the other control valve.

Further, at the right/left center portion at the rear end of the upper wall 32, there is fixedly welded a guard member 101 formed by bending a pipe member into a downwardly oriented angular hook shape. And, on the upper walls 32 on the right and left sides of this guard member 101, guard plates 102 are disposed erect thereon.

A pair of hydraulic hoses 103 for the boom cylinder 80 are provided for feeding pressure oil from the boom control valve V2 to the boom cylinder 80. A pair of hydraulic hoses 104 for the arm cylinder 81 are provided for feeding pressure oil from the arm control valve V5 to the arm cylinder 81. A pair of hydraulic hoses 105 for the bucket cylinder 82 are provided for feeding pressure oil from the bucket control valve V6 to the bucket cylinder 82. With these pairs of hydraulic hoses, when pressure oil is fed from one hydraulic hose, the pressure oil is returned from the other hydraulic hose.

In a plan view, the control valve unit 24 is disposed on an extension line of the first opening 22F and the second opening 22R of the swing bracket 22, and the hydraulic hoses 103 for the boom cylinder 80, the hydraulic hoses 104 for the arm cylinder 81 and the hydraulic hoses 105 for the bucket cylinder 82 extend from this control valve unit 24 through the first opening 22F to the second opening 22R in a substantially linear manner.

That is to say, these hydraulic hoses 103, 104, 105 are arranged on the rear side from the control valves 24 (the respective control valves V2, V5, V6) and extend between the upper and lower swing bracket pivot portions 37 and under the boom cylinder pivot portions 73 and then extend past above the first lateral shaft 74 (above the boom pivot portions 72) pivotally connecting the base portion of the boom 75 and then are inserted through the hose insertion hole 86 into the boom 75. With this arrangement, the visibility is improved.

The hydraulic hoses 103 for the boom cylinder 80, the hydraulic hoses 104 for the arm cylinder 81 and the hydraulic hoses 105 for the bucket cylinder 82 are distributed on the right and left sides, and these hydraulic hoses 103, 104, 105 are juxtaposed in the right/left direction and inserted into the boom 75. Hence, these hoses are juxtaposed inside the boom 75.

At longitudinal intermediate portions of the upper wall 32 of the boom body 83, there are formed a hole for introducing a hose connecting portion 107 provided on the side of the boom cylinder 80 or the arm cylinder 81 and a hole for introducing the hydraulic hoses. One of the hydraulic hose 103 for the boom cylinder 80 and the hydraulic hose 104 for the arm cylinder 81 is connected to the hose connecting portion 107 disposed at a longitudinally intermediate portion of the boom of the upper wall 82 of the boom body 83, and the other of the hydraulic hose 104 for the arm cylinder 81 is arranged from the boom longitudinally intermediate portion of the upper wall 32 of the boom body 83 to the outside of the boom 75 and connected to the arm cylinder 81.

At the boom longitudinally leading end portion of the outer side of the upper wall 32 of the boom body 83, there are provided a pair of right and left hose relay members 108. And, to one ends of these pared hose relay members 108, the pair of hydraulic hoses 105 for the bucket cylinder 82 are connected via holes formed in the upper wall 32 of the boom 75.

To the other end of each hose relay member 108, one end of a connecting hose 108 arranged to extend between the bracket plates 83 is connected and the other end of this connecting hose 109 is connected to the bucket cylinder 82.

Further, this connecting hose 109 is arranged to extend between the arm cylinder pivot portion 110 of the bracket plate 93 provided at the base portion of the arm 77 and the boom 75 when the arm 77 is pivoted most forwardly, and disposed along the boom 75 on the leading end of the boom 75. Thereafter, the hose 109 extends with a curve about the second lateral shaft 76 pivotally supporting the arm 77 and extends between the bucket cylinder pivot portion 111 of the bucket plate 93 and the arm 77 to the bucket cylinder 82.

Also, when the arm 77 is pivoted most rearwardly, the connecting hose 109 will slacken. In this, however, the slack hose will be curved between a reinforcing connecting pin 112 provided adjacent the arm cylinder pivot portion 110 for connecting the right and left bracket plates 83 and leading end (bucket cylinder pivot portion 111) of the piston 82B of the bucket cylinder 82 to project out of the bracket plates 93, so that the displacement of the connecting hose 109 during the pivotal movement of the arm 77 can be effectively guided by the connecting pin 112 and the piston 82B leading end of the bucket cylinder 82.

According to the backhoe 1 having the above-described construction, if the start angle θ is small, in case e.g. the tractor T is to be mounted on a carrier of a truck or the like with the backhoe 1 being attached to the tractor T, when the tractor rides over an approach slope (slope) from horizontal ground surface, if the approach slope is steep, there is the risk of the lower face of the swing bracket 22 hitting the ground surface.

The start angle θ refers to an apical angle formed between a contacting ground surface X and a segment Y contacting the lower face of the swing bracket 22 coming into contact with the contacting ground surface X (normally the vicinity of the boom pivot portion 72) when the front part of the tractor T is upwardly pivoted about the rear wheels 5 from the condition of the tractor T's contacting the horizontal contacting ground surface, with the backhoe 1 being attached to the tractor T, the segment Y contacting the rear wheels 5 also.

Therefore, with this backhoe 1, there has been a need for drawing the boom pivot portion 72 of the swing bracket 22 forwardly, thus obtaining a larger start angle θ. In this respect, in the case of such construction of the backhoe 1 as the present embodiment wherein the boom cylinder 80 is drawn out of the boom 75 to be arranged on the upper side of the boom 75 and along this boom 75, if, just like the conventional backhoe, the control valve is disposed on the upper side of the frame and the hydraulic hoses for the boom cylinder, the arm cylinder and the bucket cylinder are caused to extend between the swing bracket pivot portion 37 and the boom cylinder 80 when the boom 75 is raised and then inserted through between the boom cylinder pivot portion 73 and the boom pivot portion 72 into the boom 75, there would arise need for securing a space for allowing passage of the hydraulic hoses, hence, imposing a limit in drawing the boom cylinder 80 to the forward side. Hence, there would be imposed a limit in drawing the boom pivot portion 72 to the forward side as well.

However, according to the present invention, the hydraulic hoses 103, 104, 105 for the boom cylinder 80, the arm cylinder 81 and the bucket cylinder 82 can be arranged inside the boom 75, without having to extend between the swing bracket pivot portion 37 and the boom cylinder 80. With this arrangement, as disclosed in the present embodiment, the boom cylinder can be drawn to the forward side and the boom pivot portion 72 too can be drawn to the forward side, thus obtaining a large start angle θ.

Further, in the case of the conventional construction, the control valve unit 24 is accommodated inside the control box disposed upwardly of the frame 21. In such case, in order to form this control box sturdy, the conventional technique would require fixedly welding the control box on the step bolt-fixed on the upper wall 32 of the frame 21.

On the other hand, according to the present invention, the control valve unit 24 is disposed between the upper wall 32 and the lower wall 33 of the frame 21 and the upper wall 32 of the frame 21 is used as the step. With this, it has become possible to raise the position of the upper wall 32 to the position of the step in the conventional construction. Hence, it has become possible to raise the position of the entire frame 21 of the backhoe 1.

Consequently, the positions of the boom pivot portion 72 and the lower face of the swing bracket 22 are raised, whereby the start angle θ can be increased.

Moreover, if the control valve unit were accommodated inside the control box upwardly of the frame as in the case of the conventional construction, this would result in enlargement of the control box in order to secure sufficient space for disposing the hydraulic hoses, links etc. to be connected to the control valves. Whereas, in the case of the present embodiment, the control valve unit 24 is disposed between the upper wall 32 and the lower wall 33 of the frame 21. With this, it has become possible to simplify the control boxy 98 and to obtain a large free space forwardly of the control box 98.

The invention claimed is:

1. A tractor with a backhoe, the backhoe being mounted to a rear portion of the tractor and having a boom, an arm pivotally supported to a leading end of the boom, a bucket pivotally supported to a leading end of the arm, a boom cylinder for operating the boom, an arm cylinder for operating the arm and a bucket cylinder for operating the bucket, said tractor comprising:

a frame attached to a rear portion of the tractor;

a swing bracket having a front side and a rear side supported to a rear portion of the frame to be pivotable about a vertical axis;

a control valve unit having control valves for controlling the boom cylinder, the arm cylinder and the bucket cylinder; and a hose unit for feeding pressure oil from the control valve unit to the boom cylinder, the arm cylinder and the bucket cylinder;

wherein said swing bracket includes a first opening open to the front side and a second opening open to the rear side;

said control valve unit is disposed, in its plan view, on an extension line of said first opening and said second opening, said hose unit extending substantially straight from said control valve unit through said first opening to said second opening; and wherein said frame includes an upper wall, a lower wall spaced downwardly of the upper wall, a vertical wall disposed from the upper wall to the lower wall for interconnecting the upper and lower walls so that front and rear faces of the vertical wall are oriented in the fore and aft direction, and a pair of right and left side walls extending forwardly from the front face of the vertical wall and interconnecting the upper and lower walls, said frame further including connected portions for attaching the frame to the rear portion of the tractor; and wherein said control valve unit is disposed between the upper wall and the lower wall of the frame, said control valve unit being attached to said rear face of the vertical wall of the frame.

2. The tractor according to claim 1, wherein the upper wall of the frame is formed as a step.

3. The tractor according to claim 1, wherein said frame includes, at the rear portion thereof, a pair of upper and lower swing bracket pivot portions;

said swing bracket includes, at a front portion thereof, a pair of upper and lower pivoted portions corresponding to said upper and lower swing bracket pivot portions, respectively; and said first opening is provided between said upper swing bracket pivot portion and pivoted portion and said lower swing bracket pivot portion and pivoted portion.

4. The tractor according to claim 1, wherein said swing bracket includes, at a rear portion thereof, a boom pivot portion for pivotally supporting the base of the boom, and a boom cylinder pivot portion disposed upwardly of the boom pivot portion for pivotally supporting the base of the boom cylinder; and wherein said second opening provided between said boom pivot portion and said boom cylinder pivot portion.

5. The tractor according to claim 4, wherein said boom pivot portion has a lateral shaft for vertically pivotally supporting the boom, and said hose unit extends above said lateral shaft.

6. The tractor according to claim 5, wherein said hose unit includes a boom hydraulic hose, an arm hydraulic hose and a bucket hydraulic hose which are juxtaposed along the right and left direction within the boom.

7. A tractor with a backhoe, the backhoe being mounted to a rear portion of the tractor and having a boom, an arm pivotally supported to a leading end of the boom, a bucket pivotally supported to a leading end of the arm, a boom cylinder for operating the boom, an arm cylinder for operating the arm and a bucket cylinder for operating the bucket, said tractor comprising:

a frame attached to a rear portion of the tractor;

a swing bracket having a front side and a rear side supported to a rear portion of the frame to be pivotable about a vertical axis;

a control valve unit having control valves for controlling the boom cylinder, the arm cylinder and the bucket cylinder; and a hose unit for feeding pressure oil from the control valve unit to the boom cylinder, the arm cylinder and the bucket cylinder;

wherein said swing bracket includes a first opening open to the front side and a second opening open to the rear side;

said control valve unit is disposed, in its plan view, on an extension line of said first opening and said second opening, said hose unit extending substantially linearly from said control valve unit through said first opening to said second opening;

wherein said frame includes an upper wall; a lower wall downwardly spaced from the upper wall; a vertical wall disposed from the upper wall to the lower wall for interconnecting the upper and lower walls so that front and rear faces of the vertical wall are oriented in the fore and aft direction; and a pair of right and left side walls extending forwardly from the front face of the vertical wall and interconnecting the upper and lower walls, said frame further including connected portions for attaching the frame to the rear portion of the tractor; and wherein each right/left outer portion of each said side wall includes an outrigger frame for attaching an outrigger, each said outrigger frame having a pair of front and rear walls spaced apart in the fore and aft direction and a connecting wall for connecting right/left inner ends of said front and rear walls;

said upper wall and said lower wall each is formed of a flat plate;

said vertical wall and each said side wall each is formed of a plate member, and said front and rear walls and said connecting wall of the outrigger frame each is formed of a plate member.

8. The tractor according to claim 1, further comprising a pair of right/left outrigger frames disposed on right/left outer sides of said vertical wall for attaching right/left outriggers, respectively.

9. A tractor with a backhoe, the backhoe being mounted to a rear portion of the tractor and having a boom, an arm pivotally supported to a leading end of the boom, a bucket pivotally supported to a leading end of the arm, a boom cylinder for operating the boom, an arm cylinder for operating the arm and a bucket cylinder for operating the bucket, said tractor comprising:

a frame attached to a rear portion of the tractor;

a swing bracket having a front side and a rear side supported to a rear portion of the frame to be pivotable about a vertical axis;

a control valve having control valves for controlling the boom cylinder, the arm cylinder and the bucket cylinder; and a hose unit for feeding pressure oil from the control valve unit to the boom cylinder, the arm cylinder and the bucket cylinder;

wherein said swing bracket includes a first opening open to the front side and a second opening open to the rear side;

said control valve unit is disposed, in its plan view, on an extension line of said first opening and said second opening, said hose unit extending substantially straight from said control valve unit through said first opening to said second opening; and wherein said frame includes an upper wall, a lower wall spaced downwardly of the upper wall, and a vertical wall disposed from the upper wall to the lower wall for interconnecting the upper and lower walls so that front and rear faces of the vertical walls are oriented in the fore and aft direction, and wherein said control valve unit is disposed between the upper wall and the lower wall of the frame, said control valve unit being attached to said rear face of the vertical wall of the frame;

wherein said vertical wall has a cutout to allow communication between forward and rearward sides of the vertical wall, said swine cylinder extending from the forward side to rearward side of the vertical wall through said cutout; and wherein a swing cylinder is disposed within a space between the upper and lower walls and downwardly of the control valve unit.

* * * * *

UNITED STATES PATENT AND TRADEMARK OFFICE

CERTIFICATE OF CORRECTION

PATENT NO. : 7,682,124 B2
APPLICATION NO. : 11/375360
DATED : March 23, 2010
INVENTOR(S) : Miyazaki et al.

It is certified that error appears in the above-identified patent and that said Letters Patent is hereby corrected as shown below:

Column 16, line 1, Claim 9, "said swine cylinder" should read -- said swing cylinder --

Signed and Sealed this

Third Day of August, 2010

David J. Kappos

David J. Kappos
*Director of the United States Patent and Trademark Office*